US006528551B2

(12) United States Patent
Grochal

(10) Patent No.: US 6,528,551 B2
(45) Date of Patent: Mar. 4, 2003

(54) PROCESS FOR MANUFACTURING COMPOSITE THERMAL INSULATING SYSTEMS BY MEANS OF AN ORGANIC ADHESIVE OF FILLER MATERIAL

(75) Inventor: Peter Grochal, Waldshut (DE)

(73) Assignee: Sto Ag, Stühlingen (DE)

( * ) Notice: Subject to any disclaimer, the term of this patent is extended or adjusted under 35 U.S.C. 154(b) by 0 days.

(21) Appl. No.: 09/533,921

(22) Filed: Mar. 23, 2000

(65) Prior Publication Data

US 2002/0120021 A1 Aug. 29, 2002

(30) Foreign Application Priority Data

Mar. 24, 1999 (DE) ..... 199 13 315

(51) Int. Cl.[7] ..... C08F 16/04

(52) U.S. Cl. ..... 521/149; 264/95.1; 428/317.1; 521/65; 521/72; 521/124; 521/125; 521/130

(58) Field of Search ..... 264/45.1; 521/65, 521/72, 124, 125, 130, 149; 428/317.1

(56) References Cited

U.S. PATENT DOCUMENTS

| | | | |
|---|---|---|---|
| 4,403,013 | A | 9/1983 | Robitschek et al. |
| 5,694,736 | A | 12/1997 | Saether et al. |

FOREIGN PATENT DOCUMENTS

| | | |
|---|---|---|
| DE | 2720937 | 12/1977 |
| DE | 3202960 | 8/1983 |
| DE | 4238134 | 5/1994 |
| WO | 9002859 | 3/1990 |

*Primary Examiner*—John M. Cooney, Jr.
(74) *Attorney, Agent, or Firm*—Friedrich Kueffner

(57) ABSTRACT

A process for manufacturing composite thermal insulating systems using an organic adhesive or filler material serving as an adhesive for insulating boards to be attached to a facade or as a filler material for evening out facade unevenness prior to attaching the insulating boards or for producing a reinforcing layer on the attached insulating boards. The adhesive or filler material is foamed prior to its use.

17 Claims, No Drawings

PROCESS FOR MANUFACTURING COMPOSITE THERMAL INSULATING SYSTEMS BY MEANS OF AN ORGANIC ADHESIVE OF FILLER MATERIAL

BACKGROUND OF THE INVENTION

1. Field of the Invention

The present invention relates to a process for manufacturing composite thermal insulating systems by means of an organic adhesive or filler material serving as an adhesive for insulating boards to be attached to a facade or as a filler material for evening out facade unevenness prior to attaching the insulating boards or for producing a reinforcing layer on the attached insulating boards.

2. Description of the Related Art

In practice, such organic adhesive and filler materials are preferably processed by means of machines. When manufacturing composite thermal insulating systems which have been known for a long time and are disclosed, for example, in DE 32 02 960, insulating boards, particularly of extruded hard polystyrene foam, are placed on brickwork using an adhesive or filler material. Any unevenness of the brickwork is compensated by the adhesive or filler material. The insulating board is protected against weathering by means of a multilayer reinforced plaster coating, composed of a reinforcing layer which, in turn, is composed of a reinforcing substance and a reinforcing fabric, and a cover coating of, for example, a hard artificial resin plaster, and possibly with an additional first coating on the reinforcing layer.

In practice, predominantly cement-containing adhesives have been used for mounting the composite thermal insulating systems. The formulas of the cement-containing adhesives made it possible to apply the adhesives in thicker layers and thereby to compensate the unevenness of the background. It is possible in this manner to produce a flat facade by means of the insulating boards used for this purpose.

Particularly when refurbishing old buildings, the unevenness of the facade surface means that significant amounts of adhesive or filler material are required for evening out the surface.

Cement-free plastic-based adhesives are also already known in the art for mounting composite thermal insulating systems. The formulas are based on aqueous polymer dispersions on the basis of acrylate monomers, methacrylate monomers, vinyl acetate monomers, styrene monomers, butadiene monomers, ethylene monomers, versatic acid ester monomers and combinations thereof.

For example, DE 44 02 688 discloses an aqueous dispersion adhesive for gluing insulating boards, such as hard polystyrene foam boards. However, these polymer-bound adhesives cannot be applied in thick layers for evening out the background because they dry only slowly underneath the insulating boards. In addition, the adhesives are very difficult to process when they have the required consistency and are uneconomical because of the high quality of material that is required. For this reason, such adhesives have in the past only been used on smooth surfaces on which they could be applied in thin layers. When applied in thin layers, such adhesives dry over a normal period of time and their use is still economical.

SUMMARY OF THE INVENTION

Therefore, it is the primary object of the present invention to propose a process which makes it possible to use organic adhesive or filler materials by improving their properties in such a way that a good volume filling capacity, quick drying, long service life and cost reduction are achieved as compared to conventional organic adhesive or filler materials.

In accordance with the present invention, the adhesive or filler material is foamed prior to its use.

It has been found to be particularly useful if the material is used with a wet density after foaming of 0.3 to 1.2 kg/l, preferably 0.6 to 0.9 kg/l.

The various features of novelty which characterize the invention are pointed out with particularity in the claims annexed to and forming a part of the disclosure. For a better understanding of the invention, its operating advantages, specific objects attained by its use, reference should be had to the descriptive matter in which there are described preferred embodiments of the invention.

DESCRIPTION OF THE PREFERRED EMBODIMENTS

In accordance with a very advantageous feature of the process of the invention, foaming is effected by supplying pressurized air or another gas. It has been found that the adhesives which form stable foams as a result of the supply of air can be applied in thick layers. Consequently, this simplifies the processing of the adhesives and quick drying takes place behind the insulating boards. These adhesives then make it possible to even out the boards to obtain a flat surface.

Foaming of the material produces the result that the significantly increased volume makes it possible to even out unevenness using a much smaller quantity of material. For example, a compound for improving the adhesive, such as a resin dispersion, may also be added with the foaming agent.

It has been further found that these polymer-bound foamed adhesive or filler materials constitute excellent reinforcing substances. The foamed adhesive or filler materials form a creamy layer which can be processed very easily. In addition, significantly less material is also required for reinforcing a composite thermal insulating system.

The foamed adhesive or filler materials used in accordance with the process of the present invention make it possible to manufacture a composite thermal insulating system in which the organically bound adhesive for the insulating boards and the reinforcing substance are of the same material, thick layers can be processed very easily and the adhesive or filler materials dry quickly.

Foaming of the organic adhesive or filler materials is preferably carried out by machines. Initially, the material is conveyed by means of a mixing and conveyor pump, for example, a rotary displacement pump as it is described in DE 295 11 966, from a container, for example, a silo, through a conveying hose to a spray pistol and is sprayed onto the facade. During the conveying process, the foaming agent or the compressed air or the gas and other components can be added at the conveying pump or at the spray pistol.

Suitable as foaming agents are preferably ethylene and propylene polymers from ethylene and propylene oxide, alkyl-di-glycolether sulfate sodium salt, sodium lauryl sulfates or non-ionic tensides, such as fatty alcohol ethoxylates. An additional regulation of the foam structure can be achieved by adding silicon oils and stabilization can be achieved by foam stabilizers, such as sodium sulfosuccinamates.

Examples of an adhesive or filler material suitable for gluing and reinforcing appear below.

EXAMPLE 1

| | % by weight |
|---|---|
| Example 1 | |
| Acrylate-dispersion (binder) | 13.00 |
| Quartz powder | 74.00 |
| Glass fiber | 0.25 |
| Conservation agent | 0.20 |
| Film forming agent | 1.00 |
| Dispersing agent | 0.25 |
| Thickening agent | 0.20 |
| Foaming agent | 0.10 |
| Foam stabilizing agent | 0.10 |
| Water | 10.90 |
| Example 2 | |
| Acrylate-dispersion (binder) | 13.00 |
| Quartz powder | 74.00 |
| Glass fiber | 0.25 |
| Conservation agent | 0.20 |
| Film forming agent | 1.00 |
| Dispersing agent | 0.25 |
| Thickening agent | 0.20 |
| Foam stabilizing agent | 0.10 |
| Water | 11.00 |

In example 2, instead of using a foaming agent, approximately 30% by volume compressed air are added directly at the processing pistol.

While specific embodiments of the invention have been shown and described in detail to illustrate the inventive principles, it will be understood that the invention may be embodied otherwise without departing from such principles.

I claim:

1. A process for manufacturing composite thermal insulating systems using an organic adhesive or filler material in the form of a polymer-bound aqueous dispersion, the process comprising:

foaming the adhesive or filler material and applying the adhesive or filler material as an adhesive foam layer on a facade for subsequently mounting insulating boards on the facade.

2. The process according to claim 1, comprising using the material with a wet density of 0.3 to 1.2 kg/l after foaming.

3. The process according to claim 2, wherein the wet density is 0.6 to 0.9 kg/l.

4. The process according to claim 1, comprising effecting foaming by supplying compressed air or another gas.

5. The process according to claim 1, comprising adding a foaming agent to the material.

6. The process according to claim 5, comprising adding the foaming agent immediately prior to processing the material.

7. The process according to claim 4, comprising using as foaming agent polymers of ethylene and propylene oxide, alkyl-di-glycolether sulfate sodium salt, sodium lauryl sulfates or non-ionic tensides.

8. The process according to claim 7, wherein the non-ionic tensides are fatty alcohol ethoxylates.

9. The process according to claim 4, comprising adding an adhesive improving agent to the material.

10. The process according to claim 9, wherein the adhesive improving agent is a resin dispersion.

11. The process according to claim 1, comprising adding a foam stabilizer to the adhesive or filler material.

12. The process according to claim 11, wherein the foam stabilizer is sodium sulfosuccinamate.

13. The process according to claim 1, comprising effecting foaming immediately prior to using the material in a mixing and conveying apparatus.

14. The process according to claim 13, wherein the mixing and conveying apparatus includes an application device, further comprising controlling the foaming process such that foaming takes place when the material leaves the application device.

15. The process according to claim 14, wherein the application device is a spray nozzle.

16. A process for manufacturing composite thermal insulating systems using an organic adhesive or filler material in the form of a polymer-bound aqueous dispersion, the process comprising:

foaming the adhesive or filler material and applying the adhesive or filler material as a filler foam layer on a facade for compensating unevenness of the facade prior to mounting insulating boards.

17. A process for manufacturing composite thermal insulating systems using an organic adhesive or filler material in the form of a polymer-bound aqueous dispersion, the process comprising:

foaming the adhesive or filler material and applying the adhesive or filler material as a reinforcing foam layer on attached insulating boards.

* * * * *